US010602278B2

(12) United States Patent
Zhang

(10) Patent No.: US 10,602,278 B2
(45) Date of Patent: Mar. 24, 2020

(54) SPEAKER

(71) Applicant: AAC Technologies Pte. Ltd., Singapore (SG)

(72) Inventor: Guqing Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/234,555

(22) Filed: Dec. 27, 2018

(65) Prior Publication Data

US 2019/0246212 A1 Aug. 8, 2019

(30) Foreign Application Priority Data

Feb. 2, 2018 (CN) ..... 2018 2 0192043 U

(51) Int. Cl.

*H04R 9/06* (2006.01)
*H04R 7/18* (2006.01)
*H04R 9/02* (2006.01)

(52) U.S. Cl.

CPC ..... *H04R 9/06* (2013.01); *H04R 7/18* (2013.01); *H04R 9/025* (2013.01); *H04R 2400/11* (2013.01)

(58) Field of Classification Search

CPC . H04R 9/045; H04R 9/02; H04R 9/06; H04R 9/025; H04R 25/00; H04R 1/06

See application file for complete search history.

(56) References Cited

U.S. PATENT DOCUMENTS 7,200,241 B2 * 4/2007 Fukuyama ..... H04R 1/06 381/407
10,154,350 B2 * 12/2018 Meng ..... H04R 9/06
2013/0016874 A1 * 1/2013 Huang ..... H04R 9/043 381/433
2014/0079258 A1 * 3/2014 Fujise ..... H04R 25/00 381/312
2014/0376766 A1 * 12/2014 Chen ..... H04R 9/02 381/400
2015/0189442 A1 * 7/2015 Zhang ..... H04R 9/025 381/409
2015/0365769 A1 * 12/2015 Yoon ..... H04R 9/06 381/412
2016/0323674 A1 * 11/2016 Porter ..... H04R 9/045

* cited by examiner

*Primary Examiner* — Fan S Tsang
*Assistant Examiner* — Angelica M McKinney
(74) *Attorney, Agent, or Firm* — IPro, PLLC; Na Xu

(57) ABSTRACT

The present disclosure discloses a speaker, including a frame, a front cover forming an accommodating space with the frame and a vibration system and a magnetic circuit system which are accommodated in the accommodating space and are respectively fixed to the frame, where the magnetic circuit system includes a magnetic bowl fixed to the frame and a magnet fixed in the magnetic bowl, the magnetic bowl includes a first component forming a framework and a second component embedded into the first component, and the magnetic permeability of the second component is greater than that of the first component. The speaker of the present disclosure can improve the permeability performance of the magnetic circuit system.

11 Claims, 4 Drawing Sheets

A-A

SPEAKER

CROSS-REFERENCE TO RELATED APPLICATIONS

This application claims the priority benefit of Chinese Patent Applications Ser. No. 201820192043.8 filed on Feb. 2, 2018, the entire content of which is incorporated herein by reference.

TECHNICAL FIELD

The present disclosure relates to a speaker, and specifically, to a magnetic circuit system of a speaker.

BACKGROUND

Speakers are widely applied to portable electronic equipments such as mobile phones, notebook computers and hearing aids. With the rapid development of portable electronic equipments, people have higher requirements on functionality of the portable electronic equipments, and therefore, the speakers applied to the portable electronic equipments are also required to correspondingly rapidly develop.

A speaker related to the present disclosure mainly includes a front cover and a frame, the frame and the front cover form an accommodating cavity, and the accommodating cavity is internally provided with a magnetic circuit system and a vibration system. Generally, the magnetic circuit system includes a magnetic bowl and a magnet arranged in the magnetic bowl and forming a magnetic gap with the magnetic bowl, and the vibration system includes a vibrating diaphragm adjacent to the front cover and a voice coil connected to the vibrating diaphragm and suspended in the magnetic gap. The speaker is mainly driven by an alternative driving force in the magnetic gap when the voice coil is electrified so as to generate alternative motion, and furthermore, drive the vibrating diaphragm to move to produce a sound.

A common permeability magnetic material for preparing the magnetic bowl has advantages such as moderate material hardness and mold molding simplicity. However, the magnetic permeability of the common permeability magnetic material has reached a saturated state, and the performance of a product cannot be further improved when the magnetic bowl made of the common permeability magnetic material is used for the magnetic circuit system of the speaker. Although a magnetic superconducting material has relatively high magnetic permeability, it is not easy to bend due to relatively high hardness and brittleness, which is not conducive to the integrated molding of the magnetic bowl, and therefore, the application of the magnetic superconducting material to the magnetic circuit system of the speaker is limited.

Hence, it is desired to research a magnetic bowl that is easy to mold and good in permeability performance to improve the permeability performance of the magnetic circuit system.

DETAILED DESCRIPTION

Figure 1:
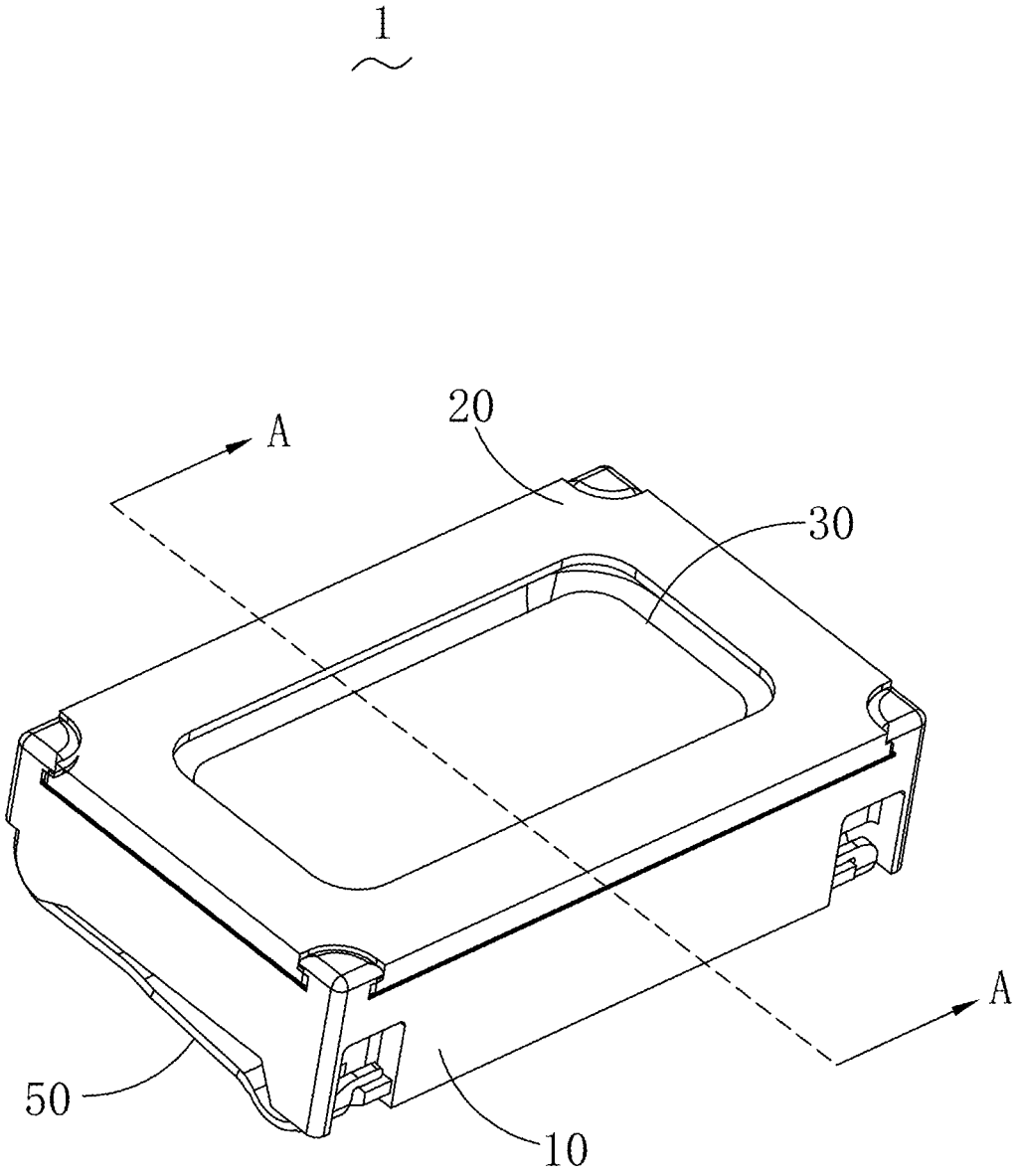
FIG. 1 is a three-dimensional view of a speaker according to the present disclosure.

The present disclosure is described below in detail with reference to FIG. 1 to FIG. 5.

As shown in FIG. 1 to FIG. 5, the speaker 1 of the present disclosure includes a frame 10, a front cover 20 forming an accommodating space with the frame 10, a vibration system 30 and a magnetic circuit system 40 which are accommodated in the accommodating space and are respectively fixed to the frame 10 and a conductive terminal 50 located on the frame 10 and configured to connect to an external circuit.

The vibration system 30 includes a vibrating diaphragm 31 fixed to the frame 10, a voice coil 32 connected to the vibrating diaphragm 31 and used for driving the vibrating diaphragm 31 to vibrate to produce a sound and a reinforcing plate 33 fixed to the vibrating diaphragm 31.

The magnetic circuit system 40 includes a magnetic bowl 41 fixed to the frame 10, a magnet 42 fixed in the magnetic bowl 41 and a pole core 43 placed on the magnet 42, a magnetic gap 44 is formed between the magnetic bowl 41 and the magnet 42, the voice coil 32 is suspended in the magnetic gap 44 and is connected to the conductive terminal 50 located on the frame 10. After being electrified, the voice coil 32 vibrates under the action of a magnetic field of the magnetic circuit system 40, and meanwhile, the voice coil 32 drives the vibrating diaphragm 31 to vibrate to produce a sound.

Figure 2:
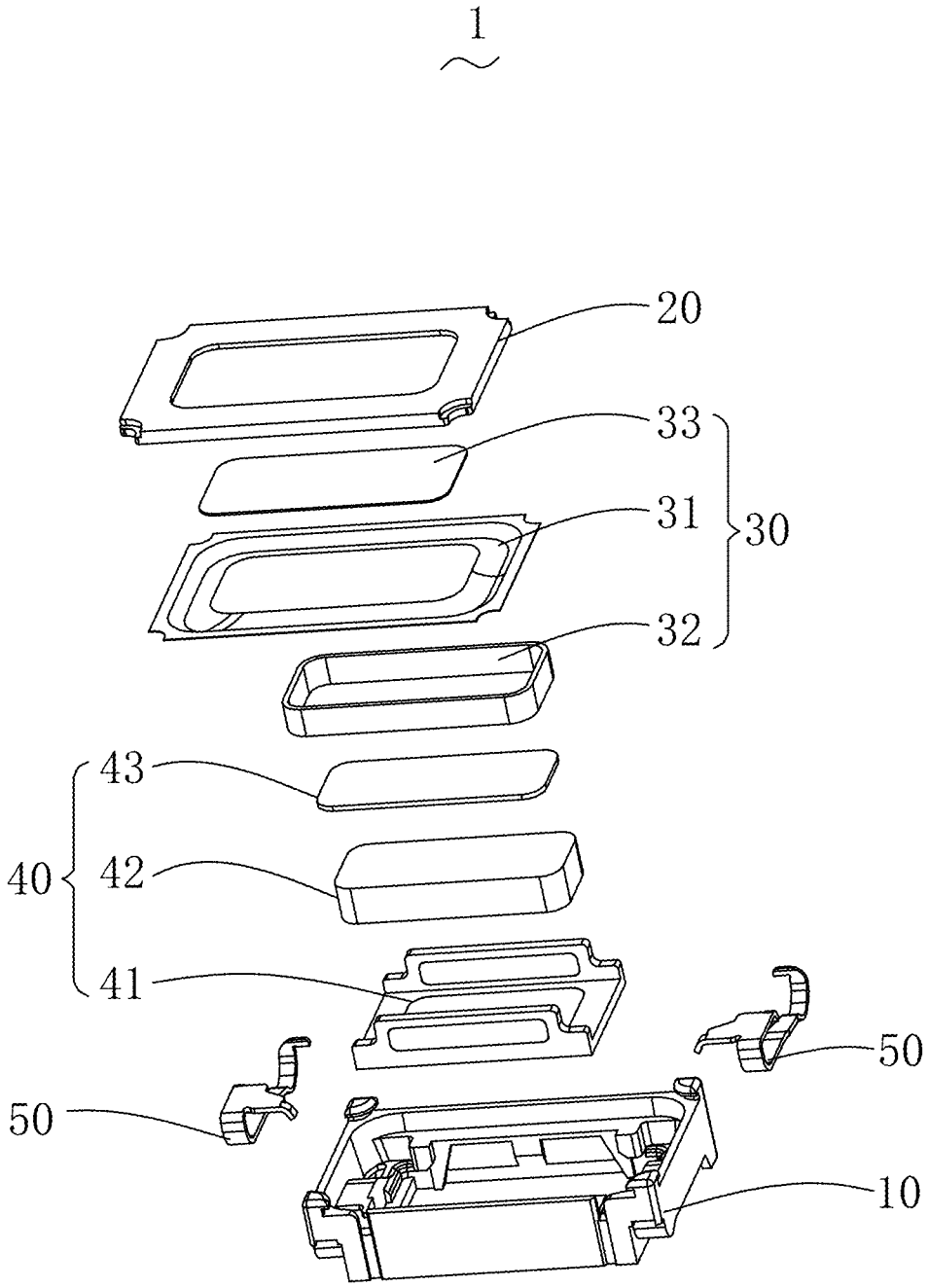
FIG. 2 is an exploded view of a speaker according to the present disclosure.
Figure 3:
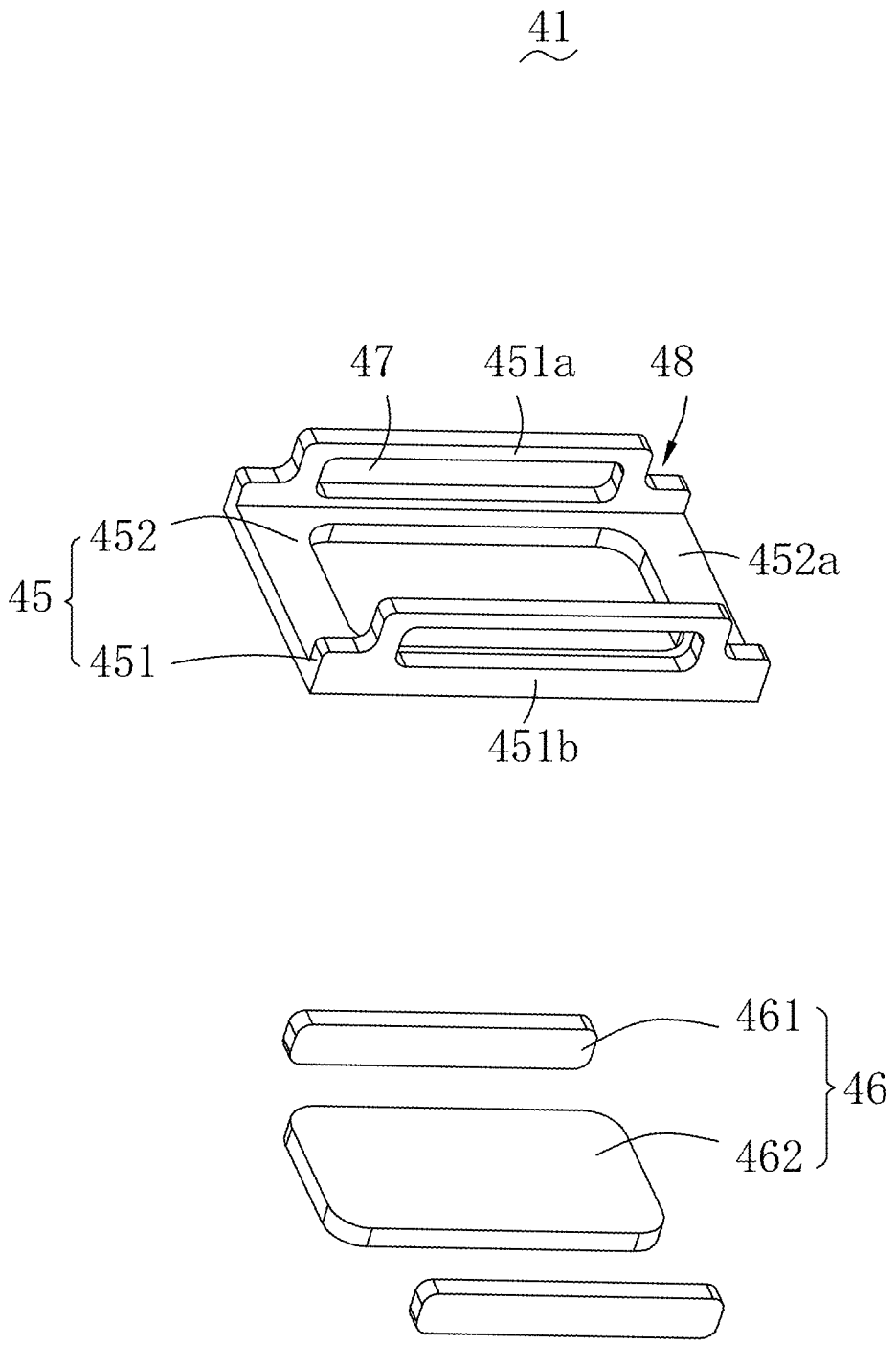
FIG. 3 is an exploded view of a magnetic bowl according to the present disclosure.

As shown in FIG. 3, the magnetic bowl 41 with the structure of this embodiment includes a first component 45 forming a framework and a second component 46 embedded into the first component 45, and the magnetic permeability of the second component 46 is greater than that of the first component 45; the first component 45 is made of a conventional permeability magnetic material, and the second component 46 is made of a magnetic superconducting material with relatively high magnetic permeability; the first component 45 includes a bottom plate 452 and a side plate 451 bending and extending from an edge of the bottom plate 452 toward the magnet 42 along a vibration direction of the vibration system 30, an embedded hole 47 is formed on the bottom plate 452 and/or the side plate 451; in addition, two ends of the side plate 451 are provided with recessed portions 48; and as can be seen from FIG. 2, the voice coil 32 is runway-shaped, and the side plate 451 is opposite to the long-axis side of the voice coil 32. In other embodiments, the magnetic bowl 41 may include a bottom plate 452 and a plurality of side plates 451, and the side plates 451 may be opposite to the long-axis side or the short-axis side of the voice coil 32.

Figure 4:
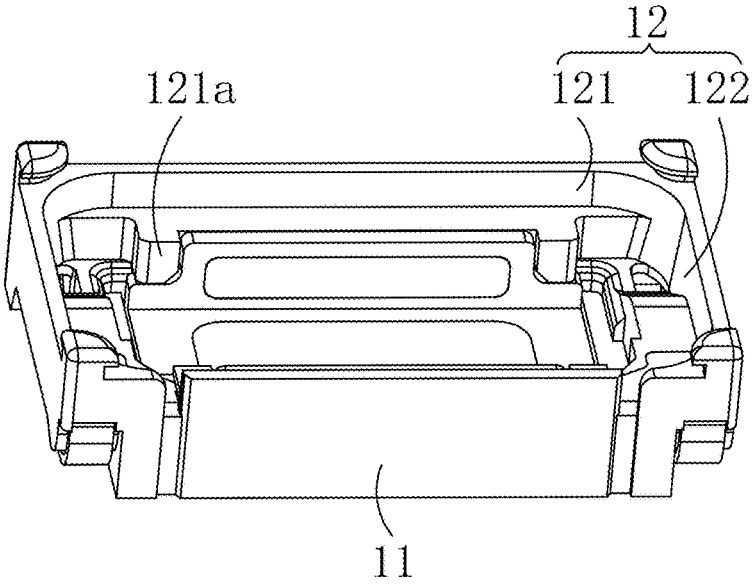
FIG. 4 is a partial three-dimensional view of a speaker according to the present disclosure.

According to the speaker 1 with the structure of this embodiment, as shown in FIG. 4, the frame 10 includes an outer side wall 11 and an inner side wall 12 that is opposite to the magnetic bowl, the inner side wall 12 includes a first inner side wall 121 parallel to the side plate 451 and a second inner side wall 122 connected to the first inner side wall 121, and two ends of the first inner side wall 121 are provided with protrusions 121*a* extending from the first inner side wall 121 to the side plate 451; and the recessed portions 48 at two ends of the side plate 451 abut against the protrusions 121*a* on the frame 10 mutually, so that the magnetic bowl 41 is fixed to the frame 10.

According to the magnetic bowl 41 with the structure of this embodiment, as shown in FIG. 3, the bottom plate 452 and the side plate 451 each are provided with the embedded hole 47, and the second component 46 includes a first magnetic conducting plate 461 embedded into the side plate 451 and a second magnetic conducting plate 462 embedded into the bottom plate 452. Thus, the magnetic superconducting material with relatively high brittleness may be made into a planar magnetic conducting plate without bending treatment, and fixed in the embedded hole 47 by using a gluing or laser spot welding. That is, the magnetic bowl 41 is integrally divided into two parts including the first component 45 and the second component 46 shaped like a flat plate. Thus, not only can the magnetic superconducting material be applied on the basis of the conventional permeability magnetic material, but also the problem of difficult in application of the magnetic superconducting material due to bending treatment incapability caused by high hardness and brittleness can be avoided, so that the permeability performance of the magnetic bowl 41 is further improved, and furthermore, the product performance of the speaker 1 is improved.

Figure 5:
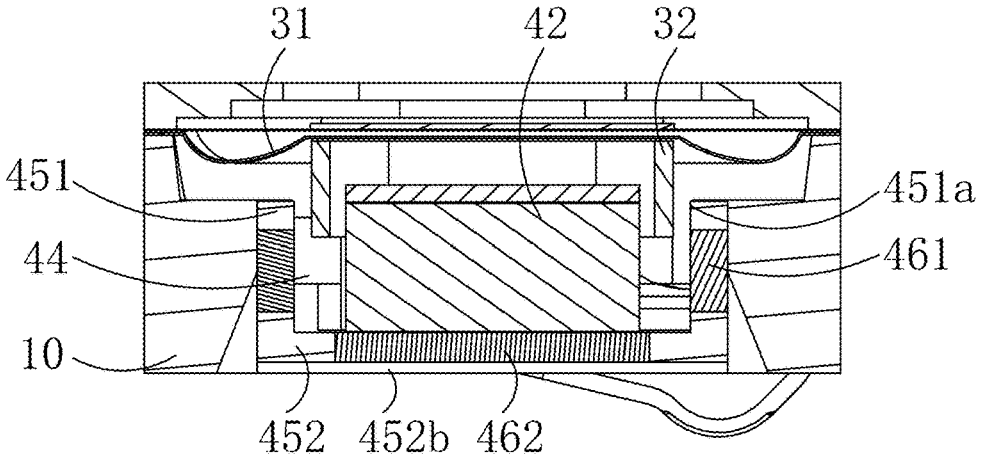
FIG. 5 is a cross-sectional view of FIG. 1 along an A-A line.

According to the speaker 1 with the structure of this embodiment, as shown in FIG. 5, the projection of the magnet 42 on the bottom plate 452 along the vibration direction of the vibration system 30 is located on the second magnetic conducting plate 462, and the magnetic permeability of the magnet is relatively high, so that the permeability performance of the magnetic bowl can be improved; and a first inner surface 451*a* of the magnetic bowl 41 and the magnet 42 are arranged oppositely to form the magnetic gap 44, the voice coil 32 is connected to the vibrating diaphragm 31 fixed to the frame 10 and is suspended in the magnetic gap 44, a projection of the voice coil 32 on the side plate 451 along a direction vertical to the vibration direction of the vibration system 30 is partially located on the first magnetic conducting plates 461, a magnetic field in the magnetic gap 44 formed by the magnet 42 and the first magnetic conducting plate 461 is stronger, and electromagnetic induction generated by inserting the electrified voice coil 32 into the magnetic gap 44 is increased, which is beneficial to the improvement of the product performance of the speaker. In other embodiments, the projection of the magnet 42 on the bottom plate 452 along the vibration direction of the vibration system 30 may be overlapped with the second magnetic conducting plate 462 or may completely cover the second magnetic conducting plate 462.

According to the magnetic bowl 41 with the structure of this embodiment, as shown in FIG. 3, the side plate 451 includes the first inner surface 451*a* and a first outer surface 451*b* which are arranged oppositely, the first inner surface 451*a* is arranged on a side close to the magnet 42, and the first outer surface 451*b* is arranged on a side close to the frame 10; the bottom plate 452 includes a second inner surface 452*a* and a second outer surface 452*b* which are arranged oppositely, the second inner surface 452*a* is connected to the first inner surface 451*a*, and the second outer surface 452*b* is connected to the first outer surface 451*b*; and the embedded hole 47 is formed by running through the side plate from the first inner surface 451*a* to the first outer surface 451*b* or is formed by running through the side plate from the second inner surface 452*a* to the second outer surface 452*b*. In other embodiments, the embedded hole 47 may also be recessed from the first inner surface 451*a* to the first outer surface 451*b*, from the first outer surface 451*b* to the first inner surface 451*a*, from the second inner surface 452*a* to the second outer surface 452*b* or from the second outer surface 452*b* to the second inner surface 452*a*, i.e. the embedded hole 47 is a blind hole as long as the second component 46 shaped like a flat plate and made of the magnetic superconducting material can be fixed to the first component 45; and in practical application, the embedded hole 47 may be formed on one or both of the bottom plate 452 and the side plate 451.

According to the magnetic bowl 41 with the structure of this embodiment, the embedded hole 47 formed on the side plate 451 and the bottom plate 452 is rectangular, round or elliptic. In other embodiments, the embedded hole 47 may also be in other irregular shapes in addition to a rectangle, a round or an ellipse. Besides, the side plate 451 or the bottom plate 452 may alternatively be provided with one or more embedded holes. Seamless embedding can be carried out by gluing or laser spot welding only when the shapes of the first magnetic conducting plate 461 and the second magnetic conducting plate 462 are consistent to those of the corresponding embedded holes on the side plate 451 and the bottom plate 452, and the first magnetic conducting plate 461 is aligned to the first inner surface 451*a* and the first outer surface 451*b* of the side plate 451, and the second magnetic conducting plate 462 is aligned to the second inner surface 452*a* and the second outer surface 452*b* of the bottom plate. In other embodiments, the first magnetic conducting plates 461 may be accommodated in the embedded hole 47 and is not aligned to the first inner surface 451*a* or the first outer surface 45 lb. Similarly, the second magnetic conducting plate 462 may also be accommodated in the embedded hole 47 and is not aligned to the second inner surface 452*a* or the second outer surface 452*b*.

The descriptions above are merely implementations of the present disclosure. It should be noted that a person of ordinary skill in the art can make improvements without departing from the concept of the present disclosure, however, the improvements shall fall into the protection scope of the present disclosure.

What is claimed is:

1. A speaker, comprising a frame, a front cover forming an accommodating space with the frame and a vibration system and a magnetic circuit system which are accommodated in the accommodating space and are respectively fixed to the frame; and the magnetic circuit system comprising a magnetic bowl fixed to the frame and a magnet fixed in the magnetic bowl, wherein the magnetic bowl comprises a first component forming a framework and a second component in plate-shaped embedded into the first component, the first component comprises a bottom plate and a side plate bending and extending from an edge of the bottom plate, and the second component has a magnetic permeability greater than that of the first component.

2. The speaker according to claim 1, wherein the side plate bending and extending from the edge of the bottom plate toward the magnet along a vibration direction of the vibration system, an embedded hole is formed on the bottom plate and/or the side plate, and the second component is fixed to the embedded hole by gluing or laser spot welding.

3. The speaker according to claim 2, wherein the side plate comprises a first inner surface and a first outer surface opposite to the first inner surface, the first inner surface is arranged on a side close to the magnet, and the first outer surface is arranged on a side close to the frame; the bottom plate comprises a second inner surface and a second outer surface opposite to the second inner surface, the second inner surface is connected to the first inner surface, and the second outer surface is connected to the first outer surface; and the embedded hole is formed by running through the side plate from the first inner surface to the first outer surface or is formed by running through the side plate from the second inner surface to the second outer surface.

4. The speaker according to claim 3, wherein the second component comprises a first magnetic conducting plate embedded into the side plate and a second magnetic conducting plate embedded into the bottom plate, and a projection of the magnet on the bottom plate along the vibration direction of the vibration system is located on the second magnetic conducting plate.

5. The speaker according to claim 4, wherein a magnetic gap is formed between the first inner surface and the magnet, the vibration system comprises a vibrating diaphragm fixed to the frame and a voice coil connected to the vibrating diaphragm and suspended in the magnetic gap, and a projection of the voice coil on the side plate along a direction vertical to the vibration direction of the vibration system is partially located on the first magnetic conducting plate.

6. The speaker according to claim 5, wherein the voice coil is runway-shaped, and the side plate is opposite to a long-axis side of the voice coil.

7. The speaker according to the claim 5, wherein the voice coil is runway-shaped, and the side plate is opposite to the long-axis side of the voice coil.

8. The speaker according to the claim 5, wherein the voice coil is runway-shaped, and the side plate is opposite to the short-axis side of the voice coil.

9. The speaker according to claim 4, wherein the first magnetic conducting plate is aligned to the first inner surface and the first outer surface, and the second magnetic conducting plate is aligned to the second inner surface and the second outer surface.

10. The speaker according to claim 2, wherein the embedded hole is rectangular or round.

11. The speaker according to claim 2, wherein the frame comprises an outer side wall and an inner side wall that is opposite to the magnetic bowl, the inner side wall comprises a first inner side wall parallel to the side plate and a second inner side wall connected to the first inner side wall, two ends of the first inner side wall are provided with protrusions extending from the first inner side wall to the side plate, and two ends of the side plate are provided with recessed portions and the recessed portions abut against the protrusions mutually.

* * * * *